US010773175B2

(12) United States Patent
Kit

(10) Patent No.: US 10,773,175 B2
(45) Date of Patent: Sep. 15, 2020

(54) TOY VEHICLE RACEWAYS

(71) Applicant: Camke Development Ltd, Hong Kong (HK)

(72) Inventor: Shek Tat Kit, Hong Kong (HK)

(73) Assignee: CAMKE DEVELOPMENT LTD, Kowloon (HK)

( * ) Notice: Subject to any disclaimer, the term of this patent is extended or adjusted under 35 U.S.C. 154(b) by 250 days.

(21) Appl. No.: 15/916,297

(22) Filed: Mar. 9, 2018

(65) Prior Publication Data

US 2019/0275439 A1 Sep. 12, 2019

(51) Int. Cl.
*A63H 18/02* (2006.01)
*A63H 18/12* (2006.01)

(52) U.S. Cl.
CPC ..... *A63H 18/02* (2013.01); *A63H 18/12* (2013.01)

(58) Field of Classification Search
CPC ..... A63H 18/02; A63H 18/12
USPC ..... 238/10 F
See application file for complete search history.

(56) References Cited

U.S. PATENT DOCUMENTS 4,150,789 A * 4/1979 Tong ..... A63H 19/30 238/10 E
4,479,650 A * 10/1984 Neuhierl ..... A63H 18/12 104/304
4,504,012 A * 3/1985 Fetty ..... A63H 18/12 104/305
4,941,610 A * 7/1990 Frauca ..... A63H 18/02 238/10 A
5,405,080 A * 4/1995 Yeung ..... A63H 18/02 238/10 F
5,678,489 A * 10/1997 Wang ..... A63H 18/021 104/56
6,176,760 B1 * 1/2001 Ngai ..... A63H 18/02 446/444
9,050,994 B2 * 6/2015 Nuttall ..... A63H 18/04
2005/0167517 A1 * 8/2005 Webster ..... A63H 19/30 238/10 R
2006/0141902 A1 * 6/2006 Sinisi ..... A63H 17/14 446/445

(Continued)

*Primary Examiner* — Jason C Smith
(74) *Attorney, Agent, or Firm* — JMB Davis Ben-David

(57) ABSTRACT

Improved toy vehicle raceways, the connector assembly mounted in the track sections of the toy vehicle raceways, the connector assembly comprising: a plug comprising a plug base, plug ribs extending from opposite side walls of the plug base and a mating tongue extending through the plug base, plug contacts located on the upper surface and lower surface of the mating tongue, wherein one of the plug contacts is positive contact and the other plug contact is negative contact, the positive contact and negative contact of the plug are arranged vertically; a socket comprising a socket base, socket ribs extending from opposite side walls of the socket base and an end extending from the rear side wall of the socket base, the socket base defining a socket housing, socket contacts located within the socket housing, wherein one of the socket contacts is positive contact and the other socket contact is negative contact, the positive contact and negative contact of the socket are arranged vertically. The present invention solves the directional problems when assembling the track sections of the toy vehicle raceways and provides more interesting, exciting and innovative toy vehicle raceways.

9 Claims, 5 Drawing Sheets

(56) References Cited

U.S. PATENT DOCUMENTS

| | | | | |
|---|---|---|---|---|
| 2017/0106303 | A1* | 4/2017 | O'Connor | A63H 18/02 |
| 2019/0275439 | A1* | 9/2019 | Kit | A63H 18/02 |

* cited by examiner

TOY VEHICLE RACEWAYS

FIELD OF THE INVENTION

The present invention generally relates to toy vehicle raceways and particularly to the improved toy vehicle raceways.

BACKGROUND OF THE INVENTION

Toy vehicle racing games have long been popular among children of varied ages and even adults. Generally the toy vehicle raceways are formed of track sections arranged to form paths. Toy vehicles are used on such raceways may be either self-powered vehicles or may receive power from an external source. In order to increase play value of the toy vehicle racing games, various amusement features have been added to the toy vehicle raceways.

A U.S. Pat. No. 9,050,994 (publication No. 2014/0194035A1) disclosed a toy vehicle raceway and rolling cart may include a plurality of multilane track segments, each of which may have a corresponding pivotally mounted support bracket. A toy vehicle raceway may be capable of being assembled in a plurality of configurations, including a racing configuration wherein the track segments and brackets may be assembled as a ramped raceway and a transport configuration wherein one or more of the track segments and brackets may be assembled to form a rolling cart for securely carrying other raceway components.

Another U.S. patent application (publication No. 20170106303A1) disclosed a relay segment for a toy track set is provided, the relay segment having a trigger moveably secured to the relay segment proximate to a first vehicle track segment pivotally mounted to the relay segment for adjustable movement with respect to the relay segment, the trigger being capable of movement between a first position and a second position; and a launching element for launching a vehicle from the relay segment when the trigger is moved from the first position to the second position.

Despite substantial variation and great effort by practitioners of the toy arts in providing evermore interesting toy vehicle raceways, there remains nonetheless a continuing need in the art for improved toy vehicle raceways.

SUMMARY OF THE INVENTION

One object of the present invention is to provide the improved toy vehicle raceways to solve the directional problems when assembling the track sections of the toy vehicle raceways, so as to prevent the wrong connection between the neighboring track sections and increase the shape variability of the toy vehicle raceways.

Another object of the invention is to provide the improved toy vehicle raceways to transfer signal, so as to provide more interesting, exciting and innovative toy vehicle raceways.

To achieve the above objects, the present invention provides the improved toy vehicle raceways, the connector assembly mounted in the track sections of the toy vehicle raceways, the connector assembly comprising: a plug comprising a plug base, plug ribs extending from opposite side walls of the plug base and a mating tongue extending through the plug base, plug contacts located on the upper surface and lower surface of the mating tongue, wherein one of the plug contacts is positive contact and the other plug contact is negative contact, the positive contact and negative contact of the plug are arranged vertically; a socket comprising a socket base, socket ribs extending from opposite side walls of the socket base and an end extending from the rear side wall of the socket base, the socket base defining a socket housing, socket contacts located within the socket housing, wherein one of the socket contacts is positive contact and the other socket contact is negative contact, the positive contact and negative contact of the socket are arranged vertically.

In one embodiment, a first connector assembly and a second connector assembly are mounted in neighboring track sections; wherein a first plug of the first connector assembly and a second socket of the second connector assembly are mounted in one track section and a first socket of the first connector assembly and a second plug of the second connector assembly are mounted in the corresponding location of another track section.

In one embodiment, the plug base defines a plug housing and the mating tongue has a front part and a rear part; wherein the front part extends longitudinally away from the plug base along a mating direction and the rear part extends through and beyond the plug housing opposite the mating direction.

In one embodiment, the upper surface and the lower surface of the front part of the mating tongue respectively define a plug slot, wherein the plug slots and the plug housing are interlinked.

In one embodiment, the plug base defines a cutting; wherein one ends of the plug contacts are exposed located in the plug slots, the other ends of the plug contacts extend beyond the plug housing and expose from the cutting along the upper surface and lower surface of the rear part of the mating tongue.

In one embodiment, the socket base defines a socket housing and the size to be contained the front part of the plug during a mating event; wherein an upper inner wall and a lower inner wall of the socket respectively define a socket slot, the socket slots and the socket housing 24 are interlinked, the socket slots extend through the rear side wall of the socket to leave openings, and the ending is located between the openings.

In one embodiment, one end of the socket contacts are exposed located in the socket slot, and the other end of the socket contacts extend beyond the openings and exposed along the upper surface and lower surface of the ending.

In one embodiment, the toy vehicle raceways include signal lines, negative power lines and positive power lines; the signal lines, the negative power lines and the positive power lines are all communicated with the PCBs.

In one embodiment, the positive contacts of the plug and socket are connected with the signal lines, the negative contacts of the plug and socket are connected with negative power lines and the positive power lines are connected through the PCBs.

In one embodiment, the toy vehicle raceways have racing tracks with different color lights; wherein the interfaces of the color lights have four pins, the middle two pins are connected with the single lines and the side pins are connected with the negative power lines.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION OF THE INVENTION

Figure 1:
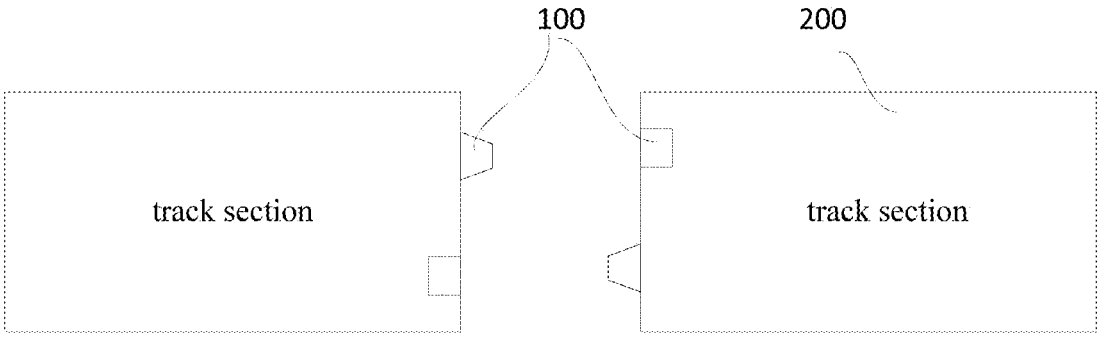
FIG. 1 is a partly perspective view of the improved toy vehicle raceways according to the present invention, wherein the connector assemblies are mounted in the track sections of the toy vehicle raceways.

The present invention would be further described herein with reference to the accompanying drawings and embodiments of the present invention. While example embodiments may include various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

FIG. 1 is a partly perspective view of the improved toy vehicle raceways according to the present invention. The connector assemblies 100 are mounted in the track sections 200 of the toy vehicle raceways. For example, there are two connector assemblies between the neighboring track sections, namely the first connector assembly and the second connector assembly in the embodiment of the present invention. Each connector assembly has a plug and a socket. Mounting directions of the first connector assembly and the second connector assembly between the neighboring track sections 200 are opposite. That is, the first plug of the first connector assembly and the second socket of the second connector assembly are mounted in one track section and the first socket of the first connector assembly and the second plug of the second connector assembly are mounted in the corresponding location of another track section.

Figure 2:
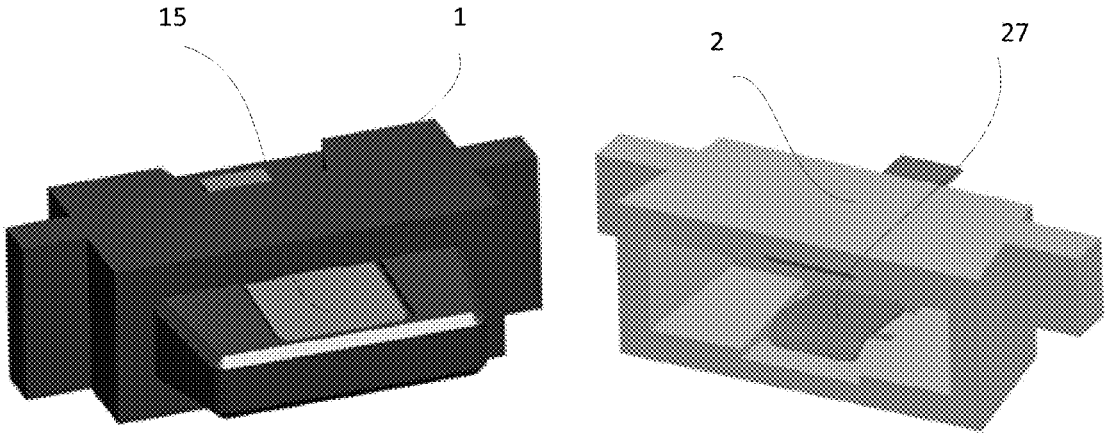
FIG. 2 is a perspective view of the connector assembly according to the present invention.
Figure 3:
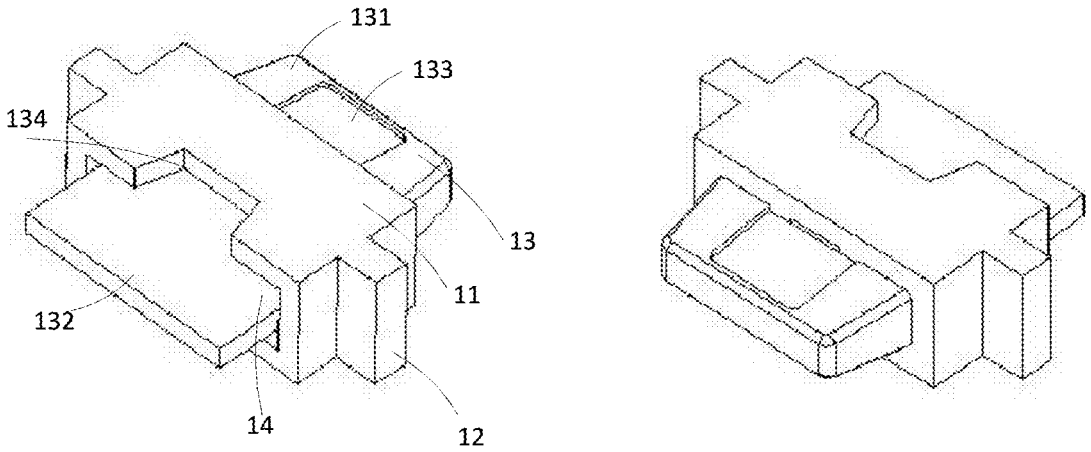
FIG. 3 is a perspective view of the plug of the connector assembly according to the present invention.

Referring to FIGS. 2 and 3, the plug 1 includes a plug base 11, plug ribs 12 extending from opposite side walls of the plug base 11 and a mating tongue 13 extending through the plug base 11. The plug ribs 12 are sized to be inserted into grooves of the track sections 200 to secure the plug 1 into the track sections 200. The plug base 11 defines a plug housing 14. The mating tongue 13 has a front part 131 and a rear part 132, wherein the front part 131 extends longitudinally away from the plug base 11 along a mating direction and the rear part 132 extends through and beyond the plug housing 14 opposite the mating direction. The front part 131 is trapezoid as preferred example and defines an upper surface, a lower surface and side surfaces extending between the upper surface and the lower surface. In the preferred embodiment, the bottom of the trapezoid mating tongue 13 is 9.5~10.5 mm width and 2.8~2.9 mm thick. The top of the trapezoid mating tongue 13 is 8~9 mm width and 2.0~2.1 mm thick. The height of the trapezoid mating tongue 13 is 3~4 mm.

The upper surface and the lower surface of the front part 131 of the mating tongue 13 respectively define a plug slot 133. The plug slots 133 and the plug housing 14 are interlinked. Furthermore, the middle rear part of the plug base 11 defines a cutting 134.

The plug 1 further includes at least two plug contacts 15. The plug contacts are arranged on the upper surface and lower surface of the mating tongue 13. Specially, one ends of the plug contacts 15 are exposed located in the plug slots 133. The other ends of the plug contacts 15 extend beyond the plug housing 14 and expose from the cutting 134 along the rear part 132. In the preferred embodiment, the plug contact 15 is 4~5 mm width. One of the plug contacts 15 is positive contact and the other plug contact is negative contact. It is very important that the positive contact and negative contact of the plug 1 are arranged vertically.

Figure 4:
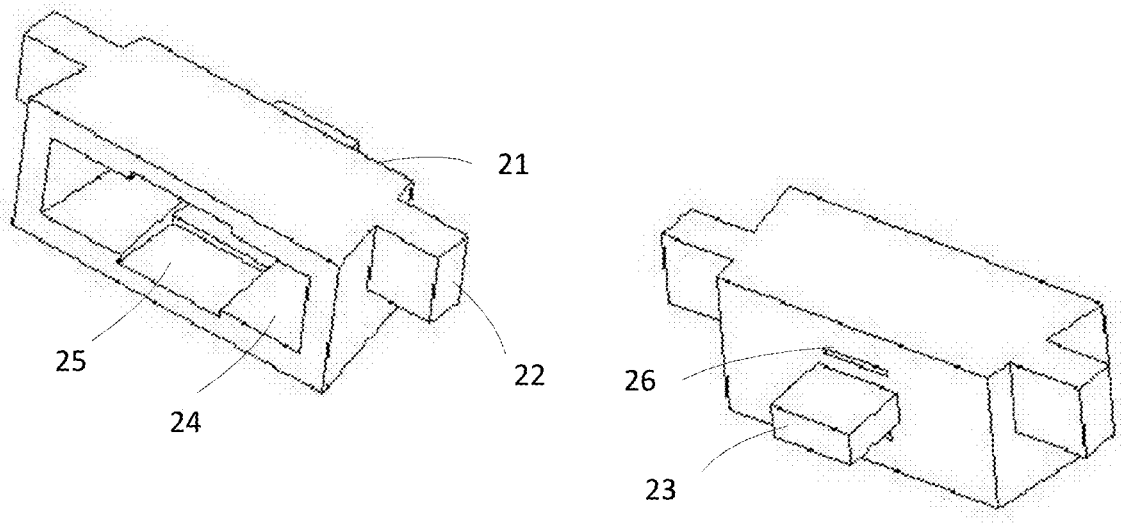
FIG. 4 is a perspective view of the socket of the connector assembly according to the present invention.

Referring to FIGS. 2 and 4, the socket 2 includes a socket base 21, socket ribs 22 extending from opposite side walls of the socket base 21 and an end 23 extending from the rear side wall of the socket base 21. The socket ribs 22 are sized to be inserted into grooves of the track sections 200 to secure the socket 2 into the track sections 200. The socket base 21 defines a socket housing 24. The socket housing 24 is trapezoid as preferred example and the size to be contained the front part 131 of the plug 1 during a mating event.

The upper inner wall and the lower inner wall of the socket 2 respectively define a socket slot 25. The socket slots 25 and the socket housing 24 are interlinked and the socket slots 25 extend through the rear side wall of the socket 2 to leave openings 26. The ending 23 is located between the openings 26.

Referring to FIG. 2, the socket further includes at least two socket contacts 27. The socket contacts 27 are arranged on upper inner wall and the lower inner wall of the socket 2. Specially, one ends of the socket contacts 27 are exposed located in the socket slot. The other ends of the socket contacts 27 extend beyond the openings and exposed along the ending 23. In the preferred embodiment, the socket contact 27 is 4~5 mm width. One of the socket contacts 15 is positive contact and the other socket contact is negative contact. It is very important that the positive contact and negative contact of the socket 2 are arranged vertically.

Figure 5:
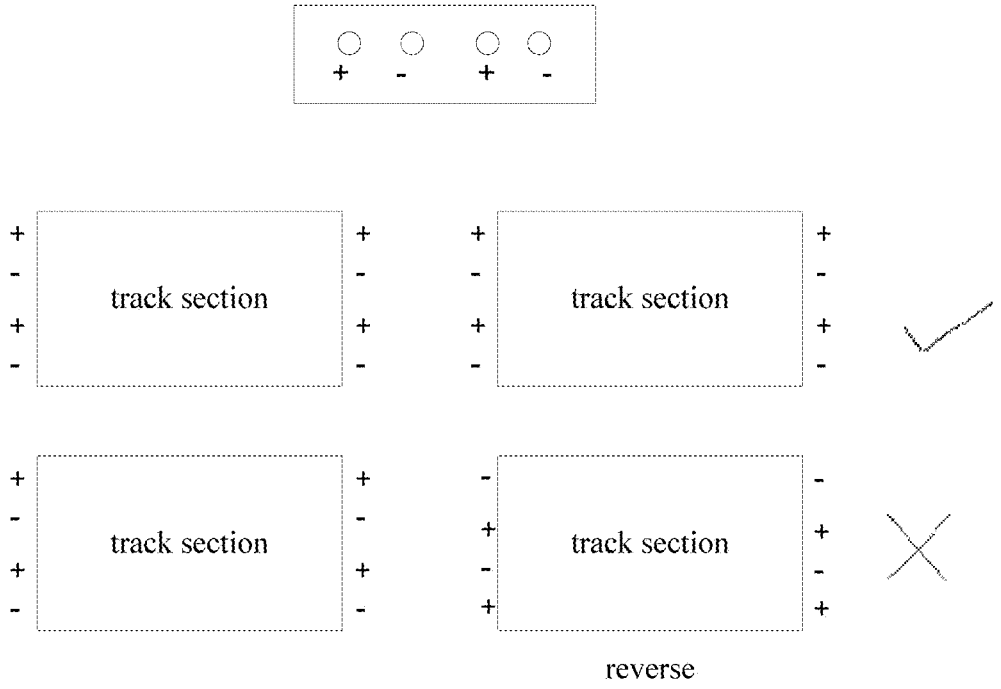
FIG. 5 is an prior art view of the connector assemblies when the track sections are assembled.

In some prior arts, each track section includes positive contacts and negative contacts for electric connection. However, the positive contacts and negative contacts are arranged horizontally as shown in the FIG. 5. When the track sections are assembled, the positive contacts must be mated with the positive contacts and the negative contacts must be mated with the negative contacts between neighboring track sections. If one of the track sections is reversed, there will be connection problems because the positive contacts cannot electronic connect with the negative contacts between neighboring track sections.

Figure 6:
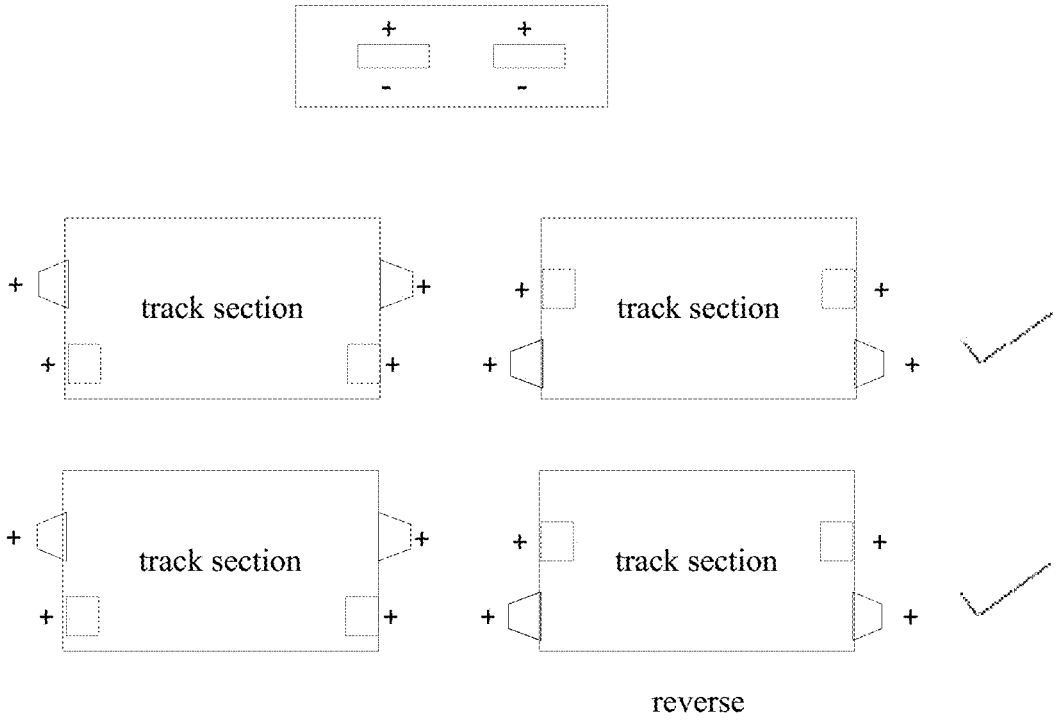
FIG. 6 is an embodiment of the connector assemblies when the track sections are assembled according to the present invention.
Figure 7:
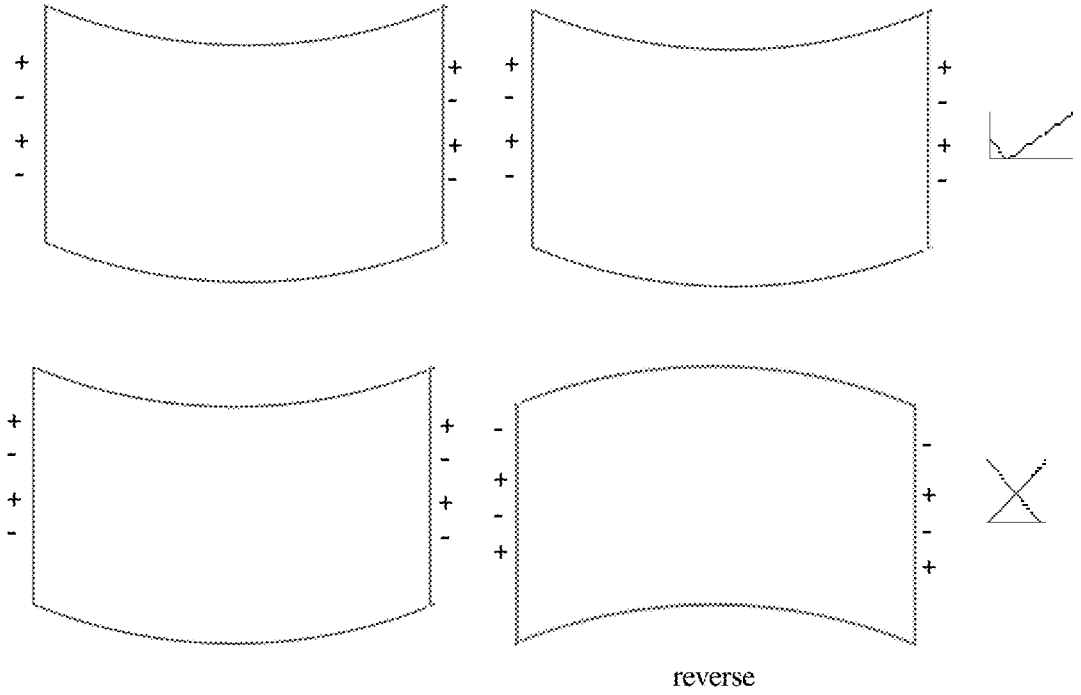
FIG. 7 is another prior art view of the connector assemblies when the track sections are assembled.

In the embodiments of the present invention, the connector assemblies 100 are added in the track sections 200. The positive contact and negative contact of the plug 1 and socket 2 are all arranged vertically. Referring to FIG. 6, when the track sections are assembled, no connection problems whether the track sections are forward or reverse. Furthermore, if the track sections are curved and the positive contacts and negative contacts of the track sections are arranged horizontally as shown in the FIG. 7, the connection is limited to a certain direction, so as to limit the possibility of changes of the toy vehicle raceways.

Figure 8:
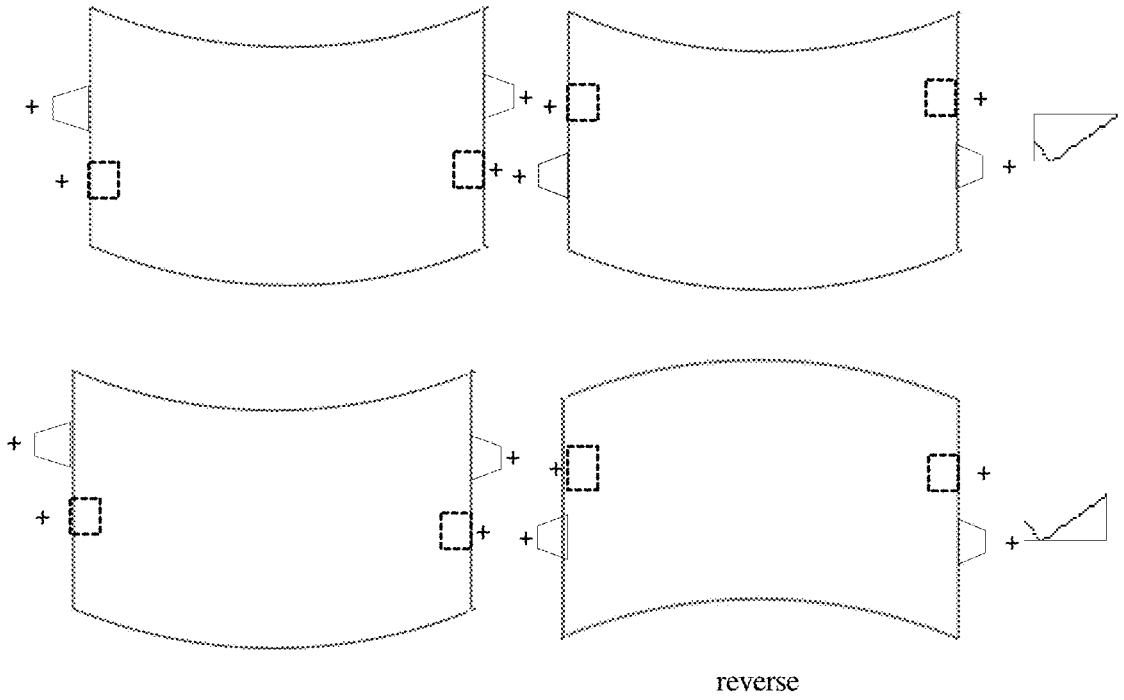
FIG. 8 is another embodiment of the connector assemblies when the track sections are assembled according to the present invention.

In the embodiments of the present invention, the positive contact and negative contact of the plug 1 and socket 2 are all arranged vertically. Referring to FIG. 8, the track sections could be assembled in forward direction and reversed direction, so as to greatly increase the shape variability of the toy vehicle raceways, especially the toy vehicle raceways are composited of multiple curved track sections.

Figure 9:
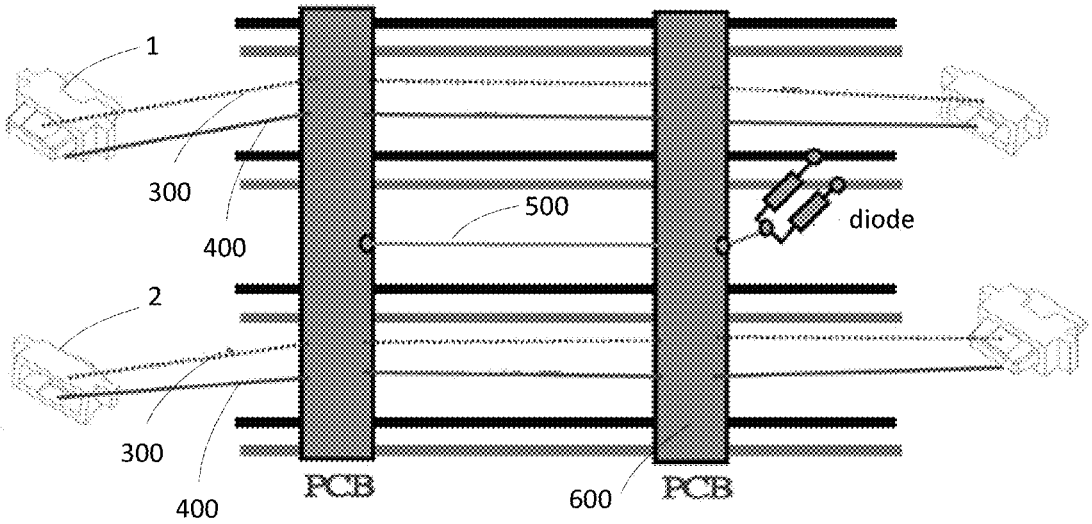
FIG. 9 is a perspective view of the connector assemblies are mounted in the track sections of the toy vehicle raceways according to the present invention.

In order to provide more interesting, exciting and innovative toy vehicle raceways, the connector assemblies 100 not only electronic connect, but also transfer signals. Referring to FIG. 9, the toy vehicle raceways include signal lines 300, negative power lines 400 and positive power lines 500. The signal lines 300, the negative power lines 400 and the positive power lines 500 are all communicated with the PCBs 600. The positive contacts of the plug 1 and socket 2 are connected with the signal lines 300, the negative contacts of the plug 1 and socket 2 are connected with negative power lines 400 and the positive power lines 500 are connected through the PCBs 600.

Figure 10:
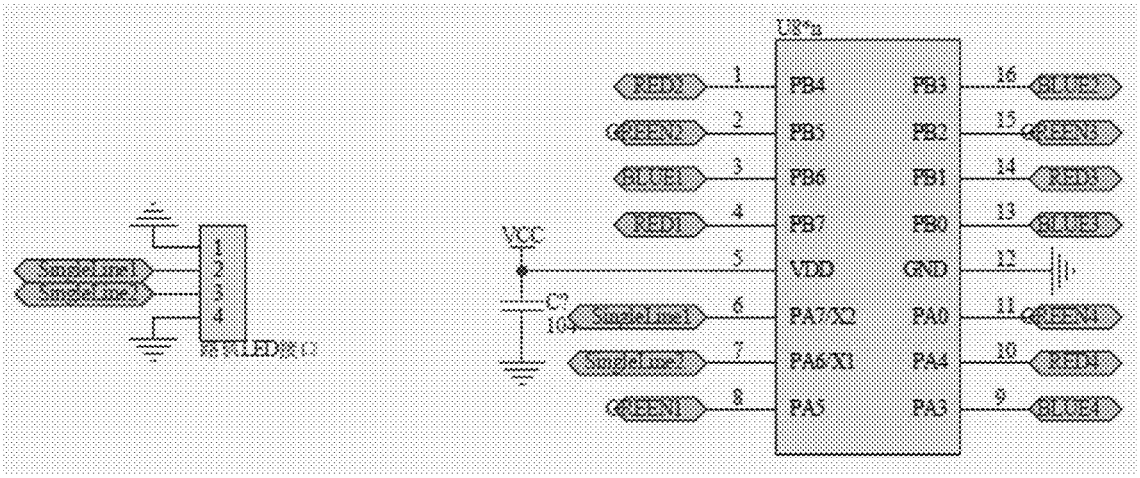
FIG. 10 is a circuit diagram of interfaces the toy vehicle raceways and a circuit diagram of interfaces of the color lights according to the present invention.

In the embodiments of the present invention, the toy vehicle raceways have racing tracks with different color lights, for example, the first racing track with the red lights, the second racing track with green lights and the third racing track with the blue lights. The circuit diagram of interfaces the toy vehicle raceways, and the circuit diagram of interfaces of the color lights are as shown in FIG. 10. The interfaces of the color lights have four pins, wherein the middle two pins (pin 2 and pin 3) are connected with the single lines 300 and the side pins (pin 1 and pin 4) are connected with the negative power lines 400. Thus, the racing tracks of the toy vehicle raceways have different color lights through the connector assemblies 100 transferring signals.

What is claimed is:

1. Improved toy vehicle raceways, the connector assembly mounted in the track sections of the toy vehicle raceways, the connector assembly comprising:

a plug comprising a plug base, plug ribs extending from opposite side walls of the plug base and a mating tongue extending through the plug base, plug contacts located on the upper surface and lower surface of the mating tongue, wherein one of the plug contacts is positive contact and the other plug contact is negative contact, the positive contact and negative contact of the plug are arranged vertically;

a socket comprising a socket base, socket ribs extending from opposite side walls of the socket base and an end extending from the rear side wall of the socket base, the socket base defining a socket housing, socket contacts located within the socket housing, wherein one of the socket contacts is positive contact and the other socket contact is negative contact, the positive contact and negative contact of the socket are arranged vertically;

wherein the plug base defines a plug housing and the mating tongue has a front part and a rear part; wherein the front part extends longitudinally away from the plug base along a mating direction and the rear part extends through and beyond the plug housing opposite the mating direction.

2. The improved toy vehicle raceways of claim 1, wherein a first connector assembly and a second connector assembly are mounted in neighboring track sections;

wherein a first plug of the first connector assembly and a second socket of the second connector assembly are mounted in one track section and a first socket of the first connector assembly and a second plug of the second connector assembly are mounted in the corresponding location of another track section.

3. The improved toy vehicle raceways of claim 1, wherein the upper surface and the lower surface of the front part of the mating tongue respectively define a plug slot, wherein the plug slots and the plug housing are interlinked.

4. The improved toy vehicle raceways of claim 3, wherein the plug base defines a cutting;

wherein one ends of the plug contacts are exposed located in the plug slots, the other ends of the plug contacts extend beyond the plug housing and expose from the cutting along the upper surface and lower surface of the rear part of the mating tongue.

5. The improved toy vehicle raceways of claim 1, wherein the socket base defines a socket housing and the size to be contained the front part of the plug during a mating event;

wherein an upper inner wall and a lower inner wall of the socket respectively define a socket slot, the socket slots and the socket housing are interlinked, the socket slots extend through the rear side wall of the socket to leave openings, and the ending is located between the openings.

6. The improved toy vehicle raceways of claim 5, wherein one end of the socket contacts are exposed located in the socket slots, and the other end of the socket contacts extend beyond the openings and exposed along the upper surface and lower surface of the ending.

7. The improved toy vehicle raceways of claim 1, wherein the toy vehicle raceways include signal lines, negative power lines and positive power lines; the signal lines, the negative power lines and the positive power lines are all communicated with the PCBs.

8. The improved toy vehicle raceways of claim 7, wherein the positive contacts of the plug and socket are connected with the signal lines, the negative contacts of the plug and socket are connected with negative power lines and the positive power lines are connected through the PCBs.

9. The improved toy vehicle raceways of claim 8, wherein the toy vehicle raceways have racing tracks with different color lights;

wherein the interfaces of the color lights have four pins, the middle two pins are connected with the single lines and the side pins are connected with the negative power lines.

* * * * *